United States Patent [19]

Bartilucci et al.

[11] Patent Number: 5,000,838

[45] Date of Patent: Mar. 19, 1991

[54] LOW EFFICIENCY DEASPHALTING AND CATALYTIC CRACKING

[75] Inventors: Mark P. Bartilucci, Victoria, Australia; Solomon W. Jacob, Cherry Hill; Grant G. Karsner, Voorhees Township, both of N.J.

[73] Assignee: Mobil Oil Corporation, Fairfax, Va.

[21] Appl. No.: 449,179

[22] Filed: Dec. 13, 1989

[51] Int. Cl.[5] ..... C10G 55/06

[52] U.S. Cl. ..... 208/86; 208/45; 208/113; 208/251 R

[58] Field of Search ..... 208/86, 251 R, 113, 208/45

[56] References Cited

U.S. PATENT DOCUMENTS

| | | | |
|---|---|---|---|
| 2,700,637 | 1/1955 | Knox, Jr. | 208/86 |
| 2,800,433 | 7/1957 | Read | 208/86 |
| 2,882,219 | 4/1959 | Johnson | 208/86 |
| 2,895,902 | 7/1959 | Peet | 208/86 |
| 3,507,777 | 4/1970 | Hemminger | 208/86 |
| 3,511,774 | 5/1970 | Long et al. | 208/251 |
| 3,951,781 | 4/1976 | Owen et al. | 208/145 |
| 4,298,456 | 11/1981 | Coombs et al. | 208/88 |
| 4,359,379 | 11/1982 | Ushio et al. | 208/113 |
| 4,673,485 | 6/1987 | Bristow et al. | 208/309 |
| 4,752,382 | 6/1988 | Eidem | 208/45 |

*Primary Examiner*—Anthony McFarlane

*Attorney, Agent, or Firm*—Alexander J. McKillop; Charles J. Speciale; Richard D. Stone

[57] ABSTRACT

A process for deasphalting a heavy hydrocarbon feed and catalytically cracking same is disclosed. Relatively low efficiency deasphalting is used to remove at least a majority of the metals in the feed, but to leave at least 10% of the asphaltenes and at least 10% of the solvent. This demetallized material is catalytically cracked. Preferably, the solvent used in deasphalting is derived from, and recycled from the catalytic cracking unit fractionator. Preferably a majority of the solvent recovery from the deasphalting step occurs in the catalytic cracking fractionator.

15 Claims, No Drawings

LOW EFFICIENCY DEASPHALTING AND CATALYTIC CRACKING

BACKGROUND OF THE INVENTION

1. Field of the Invention

This invention relates to deasphalting and catalytic cracking. More particularly, it relates to a process for obtaining a hydrocarbon oil with a low asphalt content by solvent deasphalting an asphalt-containing hydrocarbon feedstock with a liquid solvent, and catalytic cracking of the resulting deasphalted oil.

2. Description of the Prior Art

Many petroleum crude oils contain significant quantities of asphalt. Asphalts have a boiling range which coincides with that of many of the higher boiling constituents of petroleum. Since asphalts readily oxidize to form carbon and sludge, their presence is undesirable in lubricating oils. Further, due to their high coking propensity, asphalts must be excluded from catalytic cracking units where high coke levels are detrimental to catalyst performance.

Solvent deasphalting has proven effective in providing low asphalt-content petroleum fractions and has been practiced commercially for many years. In these deasphalting processes, the oil dissolves in the selected solvent while the asphalt, which is present in a dispersed state in the mineral oil, precipitates during the solvent treatment. Propane deasphalting has proven to be one of the most commercially successful of these processes, especially in the preparation of high quality lubricating oils.

The prior art is replete with solvent deasphalting processes employing a variety of solvents and solvent mixtures. Typical of this prior art is U.S. Pat. No. 2,337,448 of Carr which discloses a process for deasphalting a heavy residuum by contacting it at elevated temperatures with a deasphalting solvent such as ethane, ethylene, propane, propylene, butane, butylene, isobutane or mixtures thereof. A number of other solvents and solvent combinations are disclosed in the patent art as being useful in solvent deasphalting, including a two or three component solvent selected from hydrogen sulfide, carbon dioxide and $C_3$–$C_5$ hydrocarbons (U.S. Pat. No. 4,191,639 of Audeh et al), propylene-acetone (U.S. Pat. No. 3,975,396 of Bushnell et al) and naphtha or $C_3$–$C_5$ hydrocarbons together with small amounts of ethane, ethylene, alcohols, esters or ketones (U.S. Pat. No. 2,045,742 of Winning et al). U.S. Pat. Nos. 3,206,388 and 3,228,870 of Pitchford disclose the effectiveness of n-propyl alcohol or isopropyl alcohol containing a small quantity of water or a larger quantity of $C_5$–$C_{15}$ n-paraffin as a deasphalting solvent for either a crude oil or a fraction thereof.

Bray et al (U.S. Pat. Nos. 2,081,473 and 2,101,308) and Bray (U.S. Pat. No. 1,949,989) teach a wide range of solvents that will dissolve the oil and any wax in the oil but will not dissolve the asphalt. This extensive list includes liquified normally gaseous $C_2$–$C_4$ hydrocarbons, naphtha, and casinghead gasoline, as well as alcohol, ether, mixtures of alcohol and ether, acetone and the like. Only the preferred liquified $C_2$–$C_4$ hydrocarbons are exemplified, however.

$C_1$–$C_4$ alcohols were employed in U.S. Pat. No. 3,364,138 of Van Lookeren Campagne to remove the resins from an oil-solvent solution after the asphalt had been precipitated from a residual petroleum stock by propane. Solvent extraction of the resins from asphalt by the use of alcohols was also the subject of U.S. Pat. No. 3,003,946 of Garwin ($C_3$–$C_4$ aliphatic alcohols) and U.S. Pat. No. 2,725,192 of Kieras (n-butanol).

U.S. Pat. No. 4,548,711 Coombs et al, teaches the benefit of supercritical extraction of heavy crudes and resids in a segmented baffle tray extraction column. Solvent/feed ratios of 2.5/1 to 4.5/1 by weight offered significant advantages over the prior art solvent/feed ratios of between 7.5/1 to 10/1 by weight.

U.S. Pat. No. 4,565,623 Davis, taught deasphalting oils using miscible solvent (at a low ratio) and a carbon dioxide anti solvent. The solvents used were $C_4$–$C_{12}$ aliphatic hydrocarbons or toluene.

In U.S. Pat. No. 4,592,831, Rhoe et al used ratios of solvent to residue of at least 2:1 no greater than 4:1.

All of these processes have one thing in common, they all try to recover most of the solvent for reuse in the process. This is because the solvents used are moderately expensive and must be recovered to permit economical operation of the deasphalting process.

Some attempts were made to simply add asphaltene containing heavy feeds to catalytic cracking units. The primary difficulty with processing these heavy feeds such as resids in catalytic cracking units was the large problem created by the relatively small amount of asphaltenes, and metals which were concentrated in the asphaltene fraction. If we could "squeeze" out only these most refractory and difficult components, we could efficiently upgrade the other heavy materials in the resid fractions in the catalytic cracker. We knew the presence of minor amounts of hydrocarbon solvent would not degrade the cat cracker operation, and may even be beneficial. We knew the catalytic cracking process generates a spectrum of lighter hydrocarbon products, including naptha boiling range materials and olefinic hydrocarbons, in the $C_5$–$C_{10}$ range. These materials are ideal solvents for selective rejection of asphaltenes.

We realized that for efficient upgrading of heavy, metals laden crude, it was necessary to take a different approach. The prior art deasphalting process did a good job, but cost too much, in terms of crude loss and capital. Rather than do everything in the solvent deasphalting unit, or add resid to the catalytic cracking unit, we discovered that by intentionally doing a poor deasphalting job, using a process derived solvent, we could drastically reduce the capital and operating cost of deasphalting. By close coupling a poor deasphalting process with a conventional catalytic cracking process, we could achieve demetalation without excessive yield loss in the deasphalter, and efficiently crack the resid without destroying the cracking catalyst.

BRIEF SUMMARY OF THE INVENTION

Accordingly, the present invention provides a process for converting an asphaltene and metal containing heavy hydrocarbon feed to lighter, more valuable products characterized by: demetallizing the feed by deasphalting conditions including a solvent: feed volume ratio of about 1:1 to 4:1, using a solvent selected from the group $C_4$ to $C_{10}$ hydrocarbons and mixtures thereof, and wherein the solvent deasphalting conditions are selected to precipitate at least a majority of the metals in the feed and precipitate no more than 90 wt. % of the asphaltenes in the feed to produce a solvent rich phase containing solvent and at least 10 wt. % of the asphaltenes in the feed, and recovering from said solvent rich fraction a demetallized oil intermediate product, having a boiling range and containing at least 10 wt. % of the asphaltenes in the heavy feed to the deasphalting means, catalytically cracking the demetallized oil intermediate product in a catalytic cracking means operating at catalytic cracking conditions to produce a catalytically cracked product vapor fraction having a lower boiling range than the boiling range of the demetallized oil intermediate product; and fractionating the catalytically cracked product in a fractionation means to produce catalytically cracked product fractions. In another embodiment, the present invention provides a process for converting an asphaltene and metal containing heavy feed comprising at least 10 wt. % non-distillable hydrocarbons to lighter, more valuable products characterized by: demetallizing the feed by deasphalting the feed in a solvent deasphalting means operating at solvent deasphalting conditions including a solvent: feed volume ratio of about 1:1 to 4:1, using a recycled solvent selected from the group of $C_4$ to $C_{10}$ hydrocarbons and mixtures thereof, and wherein the solvent deasphalting conditions are selected to precipitate at least a majority of the metals in the feed and precipitate no more than 90 wt. % of the asphaltenes in the feed to produce a solvent rich phase containing solvent and at least 10 wt. % of the asphaltenes in the feed, and removing from 0 to 50% of the solvent present in said solvent rich fraction to produce a demetallized oil intermediate product, having a boiling range and containing at least 10 wt. % of the asphaltenes in the heavy feed to the deasphalting means and at least a majority of the solvent present in the solvent rich phase produced in the deasphalting means; catalytically cracking the demetallized oil intermediate product in a catalytic cracking means operating at catalytic cracking conditions to produce a catalytically cracked product vapor fraction having a lower boiling range than the boiling range of the demetallized oil intermediate product; and fractionating the catalytically cracked product in a fractionation means to produce catalytically cracked product fractions including a solvent fraction comprising $C_4$ to $C_{10}$ hydrocarbons and mixtures thereof and recycling at least a portion of said solvent fraction to said deasphalting means.

In a more limited embodiment, the present invention provides a process for demetallizing and catalytically cracking a heavy feed comprising asphaltenes, from 5 to 40 wt. conradson carbon residue and from 10 to 1000 wt. ppm (nickel + vanadium), on an elemental basis, and containing at least 10 wt. % non-distillable hydrocarbons boiling above about 100° F. to lighter, catalytically cracked products including hydrocarbons boiling in the 100° to 400° F. range characterized by: demetallizing the feed by deasphalting the feed in a hydrocarbon solvent deasphalting means operating at solvent deasphalting conditions including a solvent: feed volume ratio of about 1:1 to 4:1, using a liquid solvent consisting essentially of catalytically cracked products boiling in the 100° to 400° range, and wherein the solvent deasphalting conditions are selected to precipitate at least 70% of the nickel and vanadium in the feed, and precipitate no more than 90 wt. % of the asphaltenes in the feed to produce a solvent rich phase containing solvent, at least 10 wt. % of the asphaltenes in the feed, and 1 to 5 wt. % conradson carbon residue, and removing no more than 50% of the solvent present in said solvent rich fraction to produce a demetallized oil intermediate product having a boiling range and containing 10 to 30 wt. % solvent,; catalytically cracking the demetallized oil intermediate product and solvent in a catalytic cracking means operating at catalytic conditions to produce a catalytically cracked product vapor fraction having a lower boiling range than the boiling range of the demetallized oil intermediate product and comprising hydrocarbons boiling in the 100° to 400° F. range; and fractionating the catalytically cracked product in a fractionation means to produce catalytically cracked product fractions including a solvent fraction comprising hydrocarbons boiling in the 100° to 400° F. range and recycling at least a portion of said solvent fraction to said deasphalting means.

DETAILED DESCRIPTION

DEASPHALTING PROCESS

Although deasphalting is essential for the practice of the present invention, the precise apparatus and operating conditions are not, per se, novel.

Thus, hydrocarbon solvents mixed with one or more alcohols, may be used. Note that in "supercritical extraction", the extraction actually occurs in the liquid phase while the solvent recovery is really the supercritical part.

The use of conventional liquid/liquid deasphalting equipment is preferred. Many times existing equipment, which had been used for propane deasphalting, can be used in the practice of the present invention. Using the heavier solvents which are preferred for use herein, and use of the lower solvent/oil ratios of the present invention, it will not be possible to achieve as complete deasphalting in a given piece of equipment as it would be in the same piece of equipment operating with large amounts of propane. This is not at all detrimental, because it is also the goal of the present invention to minimize asphalt production. Quite a lot of asphalt, and practically all of the resins present in the feed, can be tolerated in the "deasphalted" oil product of the present invention. To avoid confusion, our "deasphalted" oil, which still contains a lot of asphaltenes, may be referred to hereafter as DMO, or DeMetallized Oil.

Conventional solvent deasphalting conditions can be used, with modification, discussed hereafter, to reduce the efficiency of deasphalting.

Many conventional liquid hydrocarbon solvent deasphalting units operate at temperatures from about 80° to 250° F., with a pressure sufficient to maintain all or most of the solvent in the liquid phase.

Propane deasphalting units, which are not considered suitable for use in the present invention, typically operate with large amounts of solvent, with propane: oil ratios of 6:1 to 10:1 being common. These units reject too much of potentially convertible heavy feed to the asphalt phase, and also require somewhat greater capital expense because of the high pressures usually needed to keep the propane in the liquid phase, typically 200 to 600 psig.

Not only will the "deasphalted" oil or "DMO" of the present invention have a lot of asphalt, it will also have a lot of solvent, intentionally left in during the solvent deasphalting. In the most extreme case, none of the solvent is removed or recovered from our deasphalting stage upstream of the catalytic cracking unit. This is not as extreme as it might seem, i.e., if operating with a 1:1 or 2:1 solvent: resid rate, and if 10% resid is added to a FCC unit, the practice of our invention will remove essentially all of the metals from the resid without swamping the FCC feed with solvent. The increased molar feed rate, due to the incorporation of, e.g., 10–20 wt. % relatively light solvent to the feed, will load up the FCC unit some, but much less than would the molar expansion experienced during catalytic cracking with a metal contaminated catalyst. The solvent will also help remove heat from the FCC unit.

Preferably, some of the solvent is recovered from the DMO or "deasphalted" oil intermediate the deasphalting step and catalytic cracking. This minimizes unnecessary loading up of the catalytic cracker with material which does not need to be cracked, and minimizes somewhat the amount of solvent required by the process. It is essential that at least about 10 wt. % of the DMO comprise solvent and more preferably at least 20–50 wt. % of the DMO is solvent. This minimal amount of solvent significantly improves the pumpability of the resid feed and aids in dispersion of the resid at the base of the riser of the catalytic cracking unit. This low solvent recovery can easily be achieved in a vapor/liquid flash separator, because of the extreme difference in boiling point of the solvent and the resid. It may be beneficial to have one or more stages of flash separation, coupled with changes in pressure or increases in temperature to aid in solvent recovery. The feed to the FCC must be preheated anyway, so there is no energy lost in preheating the resid, and allowing some of the solvent to flash off and be recovered for re-use in the deasphalting process. Recovery of solvent in a distillation column will usually be avoided, both because of capital cost, and the loss of energy due to refluxing the column.

The operation of the deasphalting unit should be adjusted to leave at least 10 wt. %, and preferably 10 to 50 wt. % of the CCR in the DMO product. The removal of CCR is also a function of the CCR content of the feed, and the ability of the cracking unit to burn the CCR. The DMO should usually not contain more than 5 wt. % CCR and preferably will contain about 1–2 wt. % CCR.

Metals removal is usually the key variable, and a majority of the metals (Ni+V) should be removed. Preferably no more than 30% of the metals remain. Operation of the deasphalter to leave 5–30, and preferably 7.5 to 25% of the (Ni+V) will for most units, be best. This balances loss of cat cracker feed against damage to cracking catalyst by metals in feed.

CATALYTIC CRACKING PROCESS

The catalytic cracking process is a well known process which has been in use for more than 40 years. Fluidized catalytic cracking (FCC) is by far the more popular process and is preferred. Moving bed or Thermofor catalytic cracking (TCC) is also in use and may be used in the practice of the present invention.

The catalytic cracking process per se forms no part of the invention.

The feed to the FCC or TCC unit may comprise up to 100% of "DMO" or "deasphalted" oil. This represents an extreme case, but one which is probably achievable in practice because our deasphalting process removes most of the Conradson carbon content of the resid feed, and essentially all of the metals. It may be necessary, when feeding 100% DMO, to add catalyst coolers, revert to partial CO combustion in the regenerator, or use catalyst which has an extremely low coke making tendency, or some combination of the above, in order to keep catalyst regenerator temperatures at a tolerable level.

Usually, it will be preferred to operate with only minor amounts of DMO in the FCC or TCC unit feed. Preferably at least one half of the feed is conventional catalytic cracking unit feed, with the remainder being DMO. Conventional cracking units should operate well with 10–30% DMO in the feed.

The process of our invention works very well in conjunction with conventional technology for operating with metals contaminated feed. By this we mean that it may be beneficial to practice some form of metals passivation in conjunction with the process of the present invention. Thus, addition of antimony, tin, phosphorus, or use of special catalyst with a vanadium "sink" built into the catalyst, is not outside the scope of the present invention. Both the present invention and conventional technology for dealing with metals contaminated catalyst will work well together.

If an attempt were made to add 10% resid to an FCC unit, much of the feed would end up as increased coke, and there is a serious degradation in operation of the entire catalytic cracking unit because of the presence of so much metal and asphaltenic material in the cat cracker feed. Adding resid to the feed, also makes it obligatory to practice some form of metals passivation, e.g., addition of antimony, and there is concern that this may create environmental problems and produce spent catalyst which is a disposal problem.

Conventional propane deasphalting of course produces the cleanest DMO, and minimizes problems in the FCC, but at the price of rejecting nearly $\frac{1}{3}$ or $\frac{1}{4}$ of the feed as a low value asphalt product. The capital and operating cost of classical deasphalting processes are also severe detriments to use of this process for upgrading of cat cracker feed.

It is only in the process of the present invention using "squeeze" deasphalting to produce DMO, that optimum processing of low valued resid can be realized. We operate the deasphalter so that at least 10 wt. %, and preferably 20–50% of the asphaltenes remain in the feed. We do such a poor job of recovering solvent that 20–50%, or even more, of the DMO product is still solvent. We add this material to a conventional cat cracker and, in a preferred embodiment, send much of the light product produced back to a deasphalting unit to be recycled to the cat cracker. Conventional widsom would say that not enough solvent is added to the deasphalter, and the solvent is too heavy to efficiently reject asphaltic materials. There is no efficient recovery of solvent, at least nothing like solvent recoveries, in conventional, e.g., propane deasphalting units.

This loads up the cat cracker some with solvent. This series of improbable operations, surprisingly, leads to the most efficient process for upgrading a resid.

The high capital and operating costs associated with solvent recovery in solvent deasphalting are greatly reduced, or even eliminated entirely by the process of the present invention. Much, or even all, of the solvent is left with the deasphalted residual phase.

The resid fraction, containing large amounts of solvent, is an upgraded residual fraction because of the presence of the solvent. The solvent acts like cutter stock, and significantly reduces the viscosity of the residual material, and aids dispersion and vaporization of the resid in the catalytic cracking unit.

It is possible to process relatively large amounts of resid, on the order to 10–30 wt. % of the FCC fresh feed, exclusive of recycle streams, in the FCC unit, with lower amounts of atomizing steam. Some refiners operate with relatively large amounts of atomizing steam when processing resid, sometimes amounts approaching or exceeding 4–5 wt. % steam. The solvent-resid mixture of the present invention does not require such large amounts of dispersion steam, and the FCC unit can be operated with the same, or almost the same, amounts of atomizing steam as FCC units processing lighter stocks, such as vacuum gas oils. This is beneficial because the addition of large amounts of steam is undesirable, the steam has a very large molar volume as compared to an equivalent weight of a naphtha boiling range material. Many FCC main columns are limited in the amount of water they can handle, thereby limiting the amount of dispersion steam that can be added. The present invention substitutes a heavier hydrocarbon material for the dispersion steam, and thereby unloads the upper portion of the main column.

The solvent selected can be based in part on the capacity of various levels of the FCC main column. Although a lighter solvent, an extreme example would be propane, will deasphalt well, it may reject too much crackable material to an asphalt fraction and will tend to load up the upper portions of the FCC main column. Use of a heavier material or materials will reject the worst of the asphalt material, and only marginally increase the load on lower portions of the FCC main column.

We claim:

1. A process for converting an asphaltene and metals containing heavy hydrocarbon feed to lighter, more valuable products said metals comprising Ni and V, and said process characterized by:

a. demetallizing the feed by deasphalting the feed in a solvent deasphalting means operating at solvent deasphalting conditions including a solvent: feed volume ratio of about 1:1 to 4:1, using a solvent selected from the group of $C_4$ to 400° F. hydrocarbons and mixtures thereof, and wherein the solvent deasphalting conditions are selected to precipitate at least a majority of the metals in the feed and precipitate no more than 90 wt. % of the asphaltenes in the feed to produce a solvent rich phase containing solvent and at least 10 wt. % of the asphaltenes in the feed;

b. recovering from said solvent rich fraction a demetallized oil intermediate product, having a boiling range and containing at least 10 wt. % of the asphaltenes, and 5 to 30% of the Ni and V, and at least 10 wt. % of the solvent present in the solvent rich phase produced in the deasphalting means;

c. catalytically cracking the demetallized oil intermediate product in a catalytic cracking means operating at catalytic cracking conditions to produce a catalytically cracked product vapor fraction having a lower boiling range than the boiling range of the demetallized oil intermediate product; and d. fractionating the catalytically cracked product in a fractionation means to produce catalytically cracked product fractions.

2. The process of claim 1 further characterized in that the deasphalting means comprises a liquid solvent extraction means using a liquid hydrocarbon.

3. The process of claim 2 further characterized in that the hydrocarbon solvent comprises at least a portion of the catalytically cracked product fraction.

4. The process of claim 1 further characterized in that the deasphalting means comprises a solvent extraction means using supercritical solvent recovery.

5. The process of claim 1 further characterized in that the deasphalting means comprises a liquid solvent extraction means using a liquid hydrocarbon solvent comprising a naphtha or heavy naphtha boiling range material which is recovered from the catalytically cracked product.

6. The process of claim 1 further characterized in that about 10 to 50 wt. % of the solvent present in the solvent rich phase produced in the deasphalting means is present in the demetallized oil intermediate product charged to the catalytic cracking unit.

7. The process of claim 1 further characterized in that at least a majority of the solvent present in the solvent rich phase produced in the deasphalting means is present in the demetallized oil intermediate product charged to the catalytic cracking unit.

8. The process of claim 1 further characterized in that a minority of any solvent recovery from the solvent rich phase occurs upstream of the catalytic cracking unit and a majority of the solvent recovery from the solvent rich phase occurs in the fractionation means associated with the catalytic cracking unit.

9. The process of claim 1 further characterized in that the solvent comprises catalytically cracked hydrocarbons boiling in the 200° to 400° F. range.

10. A process for converting an asphaltene and metal containing heavy feed comprising at least 10 wt. % non-distillable hydrocarbons to lighter, more valuable products characterized by:

a. demetallizing the feed by deasphalting the feed in a solvent deasphalting means operating at solvent deasphalting conditions including a solvent: feed volume ratio of about 1:1 to 4:1, using a recycled solvent selected from the group of $C_4$ to $C_{10}$ hydrocarbons and mixtures thereof, and wherein the solvent deasphalting conditions are selected to precipitate at least a majority of the metals in the feed and precipitate no more than 90 wt. % of the asphaltenes in the feed to produce a solvent rich phase containing solvent and at least 10 wt. % of the asphaltenes in the feed;

b. removing from 0 to 50% of the solvent present in said solvent rich fraction to produce a demetallized oil intermediate product, having a boiling range and containing at least 10 wt. % of the asphaltenes in the heavy feed to the deasphalting means and at least a majority of the solvent present in the solvent rich phase produced in the deasphalting means;

c. catalytically cracking the demetallized oil intermediate product in a catalytic cracking means operating at catalytic cracking conditions to produce a catalytically cracked product vapor fraction having a lower boiling range than the boiling range of the demetallized oil intermediate product; and d. fractionating the catalytically cracked product in a fractionation means to produce catalytically cracked product fractions including a solvent fraction comprising $C_4$ to $C_{10}$ hydrocarbons and mixtures thereof and recycling at least a portion of said solvent fraction to said deasphalting means.

11. The process of claim 10 further characterized in that the deasphalting means comprises a liquid solvent extraction means using a liquid hydrocarbon solvent comprising a naphtha or heavy naphtha boiling range material which is recovered from the catalytically cracked product.

12. The process of claim 10 further characterized in that a minority of the solvent is recovered from the solvent rich phase upstream of the catalytic cracking unit and a majority of the solvent is recovered in the fractionation means associated with the catalytic cracking unit.

13. The process of claim 10 further characterized in that all solvent recovery from the solvent rich phase occurs in the fractionation means associated with the catalytic cracking unit.

14. A process for demetallizing and catalytically cracking a heavy feed comprising asphaltenes, from 5 to 40 wt. % conradson carbon residue and from 10 to 1000 wt. ppm. (nickel+vanadium), on an elemental basis, and containing at least 10 wt. % non-distillate hydrocarbons boiling above about 1000° F. to lighter, catalytically cracked products including hydrocarbons boiling in the 100° to 400° F. range characterized by:

a. demetallizing the feed by deasphalting the feed in a hydrocarbon solvent deasphalting means operating at solvent deasphalting conditions including a solvent: feed volume ratio of about 1:1 to 4:1, using a liquid solvent consisting essentially of catalytically cracked products boiling in the 100° to 400° F. range, and wherein the solvent deasphalting conditions are selected to precipitate at least 70% of the nickel and vanadium in the feed, and precipitate no more than 90 wt. % of the asphaltenes in the feed to produce a solvent rich phase containing solvent, at least 10 wt. % of the asphaltenes in the feed, and 1 to 5 wt. % conradson carbon residue, on a solvent free basis;

b. removing no more than 50% of the solvent present in said solvent rich fraction to produce a demetallized oil intermediate product having a boiling range and containing 10 to 30 wt. % solvent;

c. catalytically cracking the demetallized oil intermediate product and solvent in a catalytic cracking means operating at catalytic cracking conditions to produce a catalytically cracked product vapor fraction having a lower boiling range than the boiling range of the demetallized oil intermediate product and comprising hydrocarbons boiling in the 100° to 400° range; and d. fractionating the catalytically cracked product in a fractionation means to produce catalytically cracked product fractions including a solvent fraction comprising hydrocarbons boiling in the 100° to 400° F. range and recycling at least a portion of said solvent fraction to said deasphalting means.

15. The process of claim 14 further characterized in that the demetallized oil intermediate product contains all the solvent present in the solvent rich phase produced in the deasphalting means and all solvent recovery occurs in the fractionation means associated with the catalytic cracking unit.

* * * * *